US005927839A

United States Patent [19]

Alfaro

[11] Patent Number: 5,927,839

[45] Date of Patent: Jul. 27, 1999

[54] DRAWER WITH DOUBLE-TIERED SLIDING TRAY SYSTEM

[75] Inventor: Erick E. Alfaro, Woodbridge, Canada

[73] Assignee: Snap-on Technologies, Inc., Lincolnshire, Ill.

[21] Appl. No.: 08/874,070

[22] Filed: Jun. 12, 1997

[51] Int. Cl.[6] ..... A47B 88/22

[52] U.S. Cl. ..... 312/301; 312/291; 312/334.7

[58] Field of Search ..... 312/301, 291, 312/334.7, 334.8, 334.44, 410, 408

[56] References Cited

U.S. PATENT DOCUMENTS

| | | | |
|---|---|---|---|
| 1,496,099 | 6/1924 | O'Connor | 312/301 X |
| 1,661,185 | 3/1928 | Lindsey . | |
| 1,929,762 | 10/1933 | Ulrich | 312/301 |
| 2,000,981 | 5/1935 | Parsons . | |
| 2,247,020 | 6/1941 | Hilckman | 312/301 X |
| 2,697,916 | 12/1954 | Alsing | 312/291 X |
| 2,711,944 | 6/1955 | Meek et al. . | |
| 2,721,780 | 10/1955 | Peterson et al. . | |
| 2,815,649 | 12/1957 | Di Angelus et al. | 312/408 |
| 2,912,293 | 11/1959 | Jung . | |
| 3,087,764 | 4/1963 | Schless, Jr. | 312/334.7 X |
| 3,985,409 | 10/1976 | Kneier . | |
| 4,643,494 | 2/1987 | Marleau . | |
| 4,783,971 | 11/1988 | Alba | 312/334.44 X |
| 4,993,786 | 2/1991 | De Giulio . | |
| 5,037,165 | 8/1991 | Rapp et al. . | |
| 5,044,059 | 9/1991 | De Giulio . | |
| 5,105,953 | 4/1992 | Finnegan . | |
| 5,443,311 | 8/1995 | Kadlecek et al. | 312/291 X |
| 5,468,062 | 11/1995 | Finnegan . | |
| 5,484,092 | 1/1996 | Cheney . | |

FOREIGN PATENT DOCUMENTS

| | | | |
|---|---|---|---|
| 160161 | 12/1954 | Australia | 312/408 |
| 306701 | 3/1989 | European Pat. Off. | 312/334.7 |
| 951635 | 10/1956 | Germany | 312/301 |
| 154291 | 3/1956 | Sweden | 312/301 |

*Primary Examiner*—Jose V. Chen
*Assistant Examiner*—Hanh V. Tran
*Attorney, Agent, or Firm*—Emrich & Dithmar

[57] ABSTRACT

A drawer having a longitudinal axis is provided. The drawer includes first and second generally parallel sidewalls, a bottom wall connecting the first and second sidewalls and first and second tray supports respectively connected to the first and second sidewalls. The drawer also includes an upper tray system supported on the first and second tray supports including at least one upper tray slideably supported on the first and second tray supports and slideable along the longitudinal axis of the drawer, and a lower tray system supported on the first and second tray supports and disposed above the bottom wall and below the upper tray system. The lower tray system includes at least one slideable lower tray slideably supported on the first and second tray supports above the bottom wall and slideable along the longitudinal axis of the drawer.

15 Claims, 4 Drawing Sheets

DRAWER WITH DOUBLE-TIERED SLIDING TRAY SYSTEM

BACKGROUND OF THE INVENTION

1. Field of the Invention

This invention relates to storage devices and, more particularly, to storage trays for drawers.

2. Description of the Prior Art

Simple drawers only allow the bottom of a drawer to be used. It is often desirable, however, to utilize the entire volume of a drawer and organize tools, or other contents, within a drawer. Drawers have previously been provided with trays for this purpose. These drawers, however, have limited versatility.

While the use of a slideable tray is known, prior drawers usually only have one slideable tray on a single level near the top of the drawer. Other drawers have been provided with trays disposed at different levels. However, these drawers include a tray on the bottom level that is not slideable and usually covers the entire area of the bottom wall of the drawer and, therefore, does not allow any objects to be stored between the bottom tray and the bottom wall of the drawer.

SUMMARY OF THE INVENTION

It is a general object of the invention to provide an improved drawer which avoids the disadvantages of prior drawers while affording additional structural and operational advantages.

An important feature of the invention is the provision of a drawer having tiers of trays and which is of a relatively simple and economical construction.

A still further feature of the invention is the provision of a drawer of the type set forth, which provides maximum usage and versatility of its storage space.

Yet another feature of the invention is the provision of a drawer of the type set forth, which is resistant to damage caused by movement of the trays.

These and other features of the invention are attained by providing a drawer having a longitudinal axis, and including first and second generally parallel sidewalls, a bottom wall connecting the first and second sidewalls and first and second tray supports respectively connected to the first and second sidewalls. The drawer also includes an upper tray system supported on the first and second tray supports, including at least one upper tray slideably supported on the first and second tray supports and slideable along the longitudinal axis of the drawer, and a lower tray system supported on the first and second tray supports and disposed above the bottom wall and below the upper tray system. The lower tray system includes at least one slideable lower tray supported on the first and second tray supports above the bottom wall for sliding movement along the longitudinal axis of the drawer.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
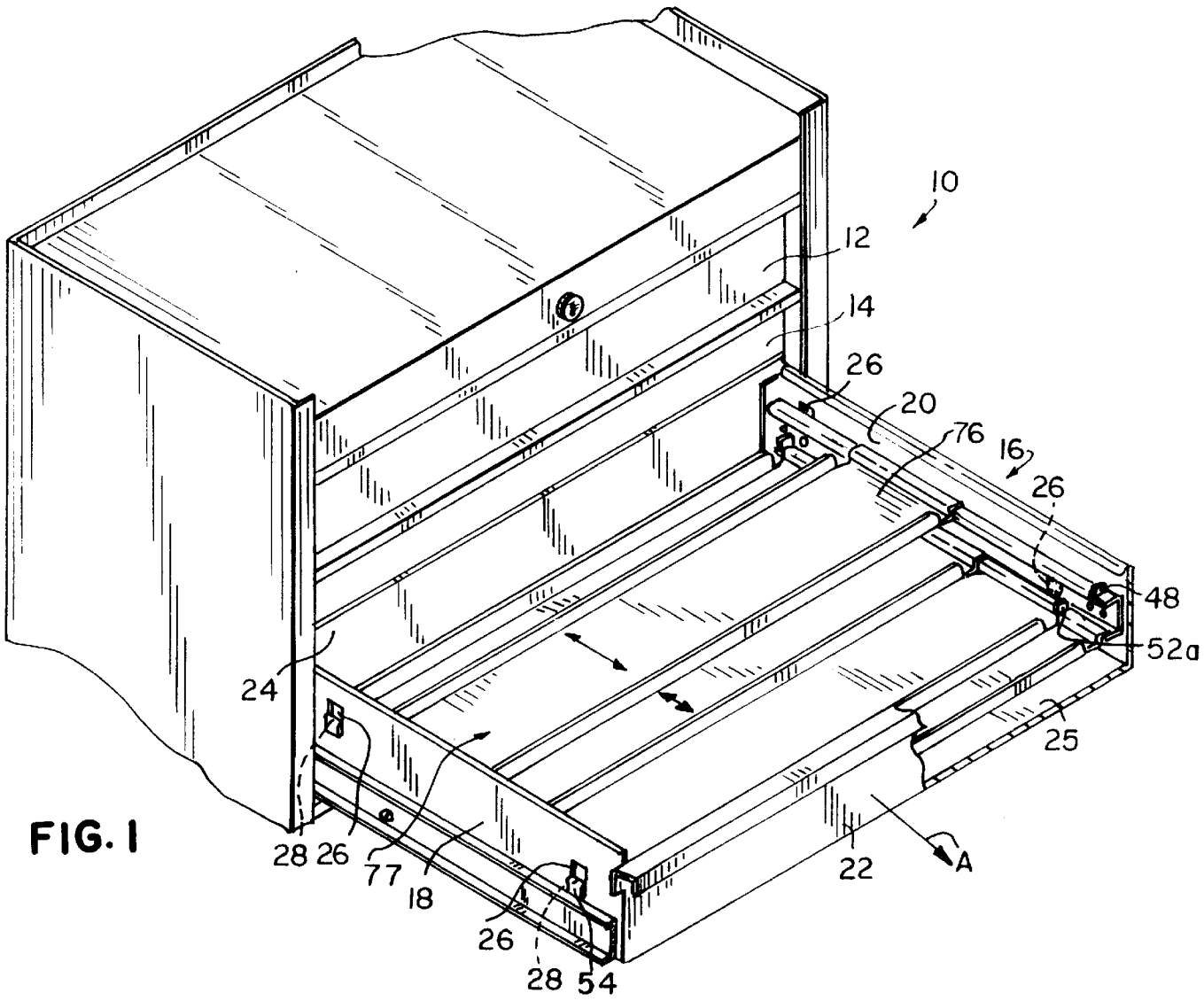
FIG. 1 is a fragmentary perspective view of a tool chest including the drawer of the present invention.
Figure 5:
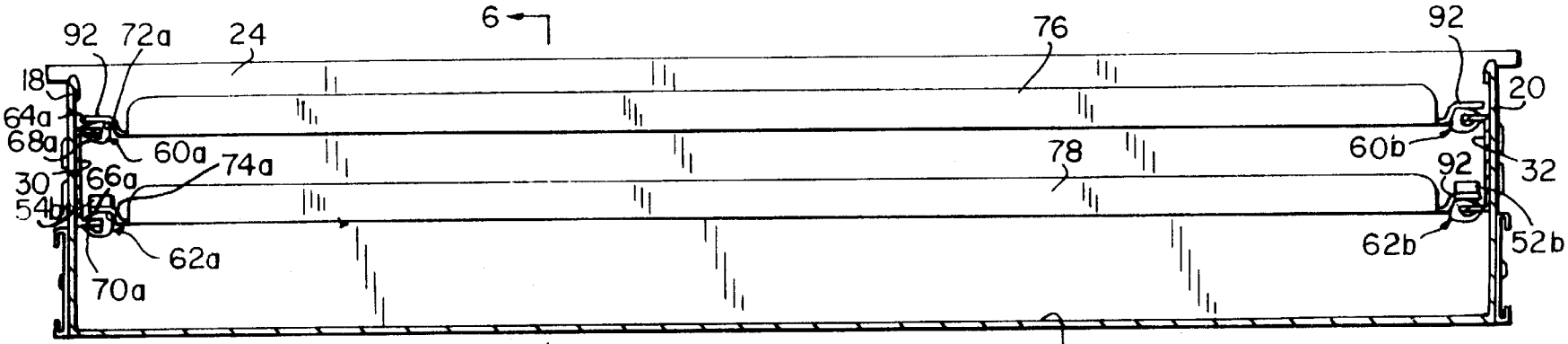
FIG. 5 is a sectional view of the drawer of the present invention taken generally along the line 5—5 of the drawer of FIG. 6.
Figure 6:
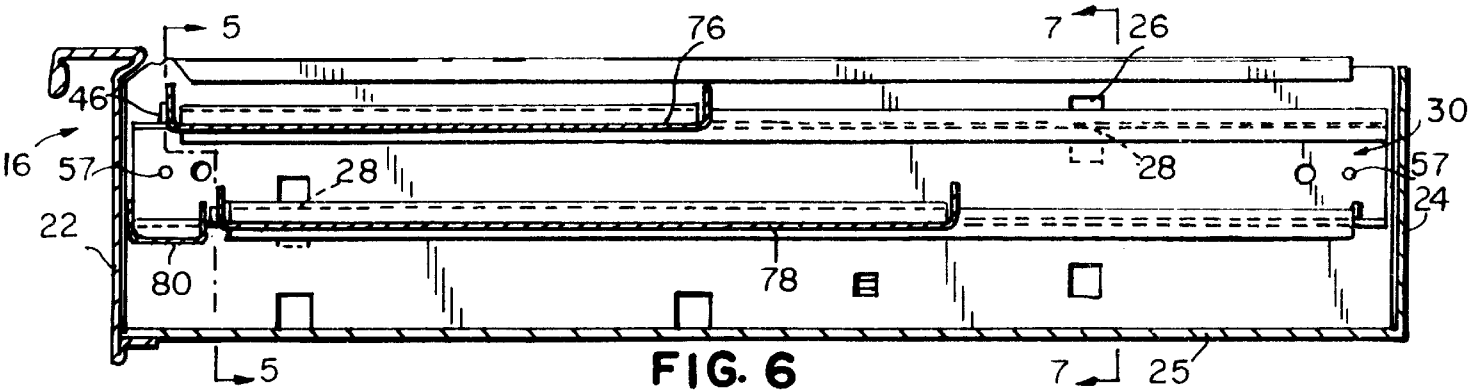
FIG. 6 is a sectional view taken generally along the line 6—6 of FIG. 5.

Referring to FIG. 1, a tool chest 10, or other drawer receptacle, is illustrated which includes drawers 12, 14 and 16. Drawer 16, as seen in FIGS. 1, 5 and 6, includes two generally parallel sidewalls 18 and 20, a drawer front 22 substantially perpendicular to and interconnecting the sidewalls 18, 20, a rear wall 24 substantially perpendicular to and connected to the sidewalls 18, 20 and a bottom wall 25 connected to the sidewalls 18, 20, the rear wall 24 and the drawer front 22. Drawer 16 has a longitudinal axis "A" (FIG. 1) substantially parallel to sidewalls 18, 20 therethrough. Each of the sidewalls 18, 20 has two rectangular apertures 26. Each of the apertures 26 is substantially identical to the other and has a bottom edge.

As seen best in FIGS. 1, 2, 5, 6 and 7, the drawer 16 also includes a tiered tray system 29. The tiered tray system 29 includes two, elongated, generally U-shaped tray supports 30, 32, respectively connected to sidewalls 18, 20. Each tray support 30, 32 is a mirror image of the other. Tray supports 30, 32 are of one-piece construction and usually made of a metal, and respectively include upper rails 34, 36, lower rails 38, 40 substantially parallel to the upper rails 34, 36 and support walls 42, 44, connecting an associated upper and lower rails 34, 36 and 38, 40. Each of support walls 42, 44 has a height as measured between the associated upper and lower rails. The upper rails 34, 36 have substantially coplanar upper support surfaces, as do the lower rails 38, 40.

Upper rails 34, 36 respectively include upper tray stops 46, 48 adjacent to the front ends thereof. Each upper tray stop 46 and 48 may be formed by punching out a portion of the respective upper rail 34, 36 and bending that portion up so it is in a plane substantially perpendicular to the respective upper rail 34, 36.

Similarly, lower rails 38, 40 respectively include pairs of longitudinally spaced-apart lower tray stops 50*a*–50*b*, 52*a*–52*b*, which can be formed in the same manner as upper tray stops 46, 48. Lower tray stops 50*a*, 52*a* are disposed closer to the drawer front 22, while lower tray stops 50*b*,52*b* are disposed closer to the rear wall 24.

Figure 8:
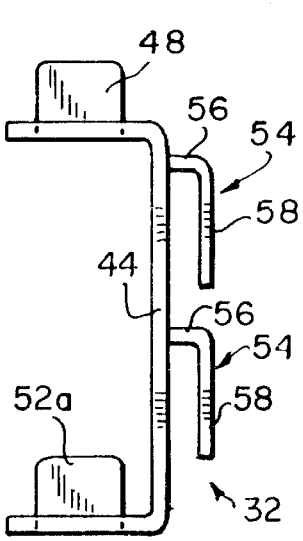
FIG. 8 is a further enlarged end elevational view of the tray support of FIG. 4, taken along line 8—8 therein.

Each tray support 30, 32 also includes two tabs 54. Each tab 54, as best seen in FIG. 8, includes a shoulder portion 56 connected to and projecting laterally from a respective support wall 42, 44 and a retaining portion 58 substantially parallel to the respective support wall 42, 44.

The tray supports 30, 32 are, respectively, connected to sidewalls 18, 20 of the drawer 16 by inserting each tab 54 through a mating aperture 26 and allowing the respective tray support 30, 32 to move downwards so that each shoulder portion 56 sits on the bottom edge of the associated aperture 26. If desired, the tray supports 30, 32 may be further secured by placing a screw, bolt or other fastener (not shown) through apertures 57 in the support walls 42, 44 and associated apertures (not shown) in drawer sidewalls 18, 20. Further, for universal use, the tray supports 30, 32 may be made without the tabs 54 and fastened only with a screw or bolt to the sidewalls of various sized drawers. The tray supports 30, 32 are longitudinally positioned on sidewalls 18, 20 so that upper tray stops 46, 48 lie in a first common plane, lower tray stops 50*a* and 52*a* lie in a second common plane and lower tray stops 50*b* and 52*b* lie in a third common plane, the first, second and third planes being substantially perpendicular to the longitudinal axis A of the drawer 16.

Figure 2:
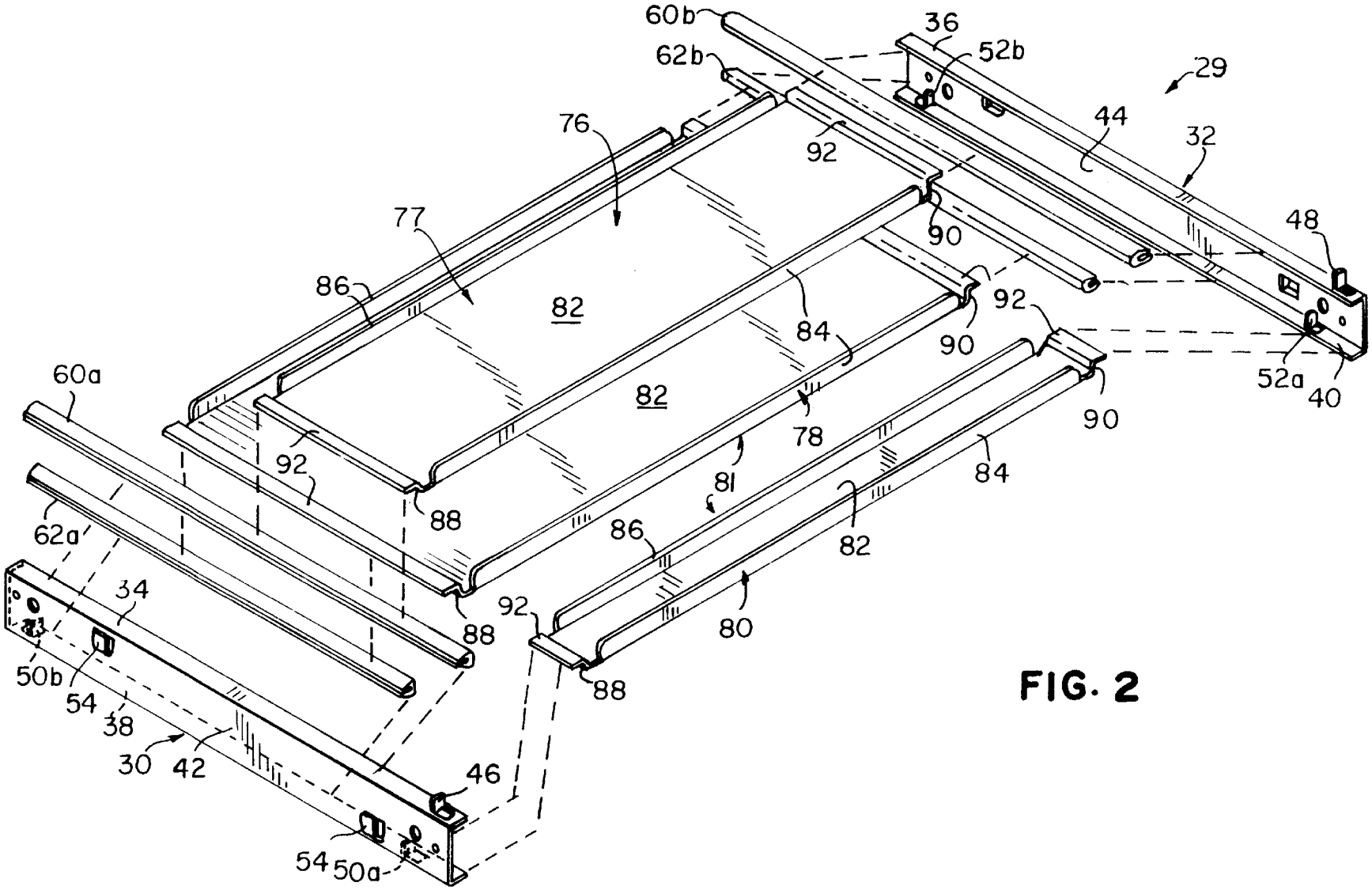
FIG. 2 is an enlarged, exploded, perspective view of the double-tiered tray system of the drawer of FIG. 1.
Figure 3:
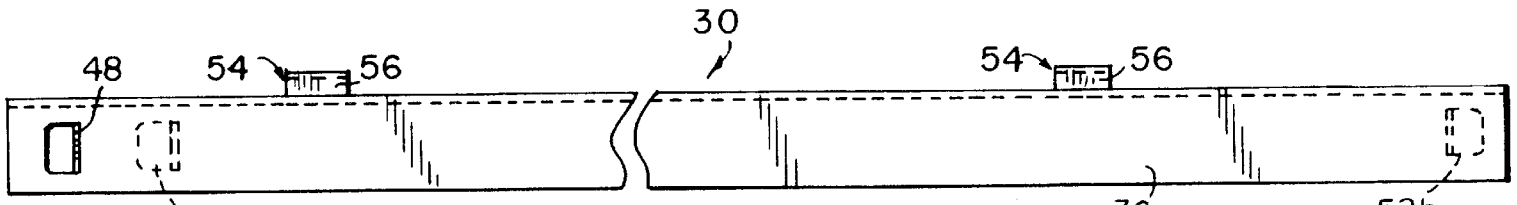
FIG. 3 is a further enlarged top plan view of one of the tray/supports of the tray system of FIG. 2, with portions broken away.
Figure 4:
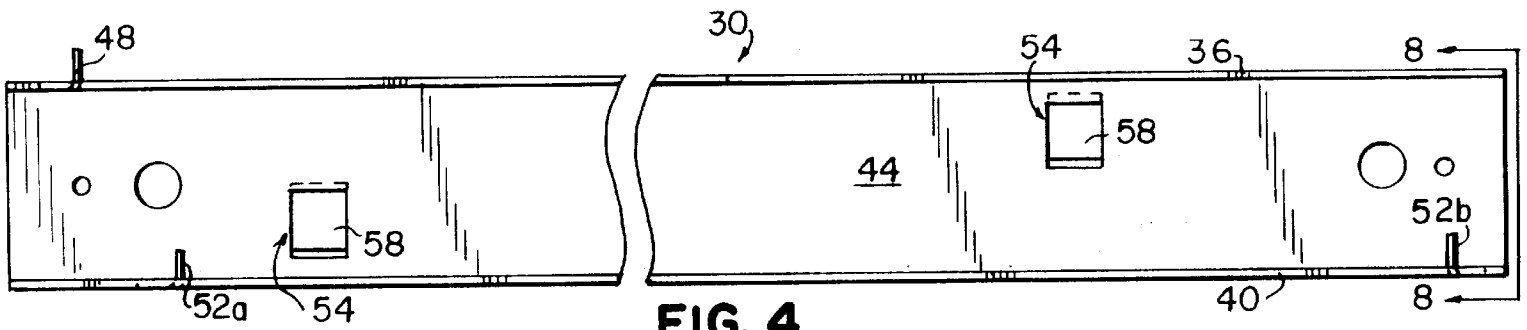
FIG. 4 is a side elevational view of the tray support of FIG. 3.
Figure 7:
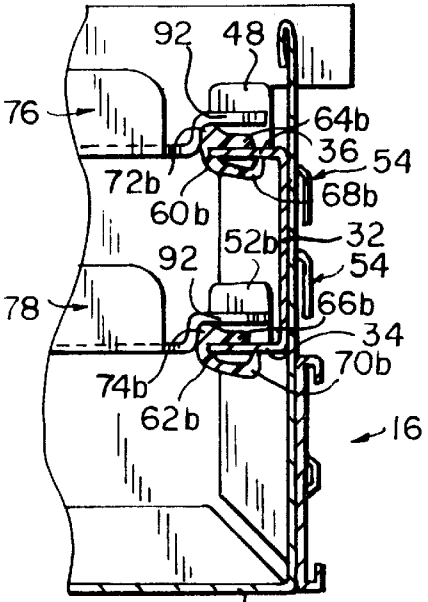
FIG. 7 is an enlarged, fragmentary, perspective view of the right-hand portion of the drawer of FIG. 5.

The tiered tray system 29 also includes two upper glides 60*a*, 60*b*, respectively disposed on upper rails 34, 36, and two lower glides 62*a*, 62*b*, respectively disposed on lower rails 38, 40. The glides 60*a*, 60*b*, 62*a*, 62*b* are made of a flexible, resilient, low coefficient-of-friction material and aid in, as discussed below, facilitating tray sliding and preventing damage to the upper rails 34, 36 and lower rails 38, 40. The glides 60*a*, 60*b*, 62*a*, 62*b*, as best seen in FIGS. 2, 5 and 7, are generally U-shaped and, respectively, have upper legs 64*a*, 64*b*, 66*a*, 66*b* and lower legs 68*a*, 68*b*, 70*a*, 70*b*. The upper legs 64*a*, 64*b*, 66*a*, 66*b*, respectively, include raised portions 72*a*, 72*b*, 74*a*, 74*b* for producing a smaller area to contact trays, as discussed below.

The tiered tray system 29 also includes three trays 76, 78 and 80. The trays 76, 78, 80 are identical except for their front-to-back widths. Each tray 76, 78, 80 includes a bottom tray wall 82 connected to an upstanding front tray wall 84, an upstanding rear tray wall 86 and two generally parallel upstanding tray sidewalls 88, 90. The distance between the outermost portions of the front and rear tray walls 84 and 86 defines the width of each tray 76, 78 and 80. Each tray 76, 78 and 80 also has a pair of substantially coplanar flanges 92, respectively integral with the tray sidewalls 88, 90 and extending laterally outwardly therefrom.

As seen in FIGS. 5, 6 and 7, tray 76 forms an upper tray system 77 and is slideably supported on upper rails 34, 36, with flanges 92 lying on the raised portions 72*a*, 72*b* of upper glides 60*a*, 60*b*. The tray 76 is thus easily removeable from the drawer 16 and the tiered tray system 29. Tray 76 is longitudinally slideable between the rear wall 24 and the upper tray stops 46, 48. Though upper tray system 77 preferably only has one slideable tray 76, additional slideable trays can be included in the upper tray system 77, each being easily removeable from the drawer 16 and tiered tray system 29.

Trays 78 and 80 form a lower tray system 81. Tray 78 is slideably supported on lower rails 38, 40, with flanges 92 of tray 78 lying on the raised portions 74*a*, 74*b* of lower guides 62*a*, 62*b*. Tray 78 is longitudinally slideable between the lower tray stops 50*a*, 52*a* and the lower trays stops 50*b*, 52*b*. Though lower tray system 81 preferably only has one slideable tray 78, more than one slideable tray can be included in the lower tray system 81. Depending upon the width of the trays of the lower tray system 81 and the height of the support walls 42, 44, the trays 78, 80 may or may not be removeable. Preferably, tray 80 is removeable from the drawer 16 and tiered tray system 29. Tray 80 preferably has a small width, such as one inch, and is useful to hold screws and other small items.

Tray 80 is non-slideable and its flanges 92 are disposed directly on lower rails 38, 40 between lower tray stops 50*a*, 50*b* and the drawer front 22.

Trays 76 and 78 can have a wide variety of widths. Tray 76 preferably has a width smaller than the distance between the upper tray stops 46 and 48 and the rear wall 24 to allow tray 76 to slide longitudinally, so that access can be gained to any items stored in trays 78, 80 disposed on the lower rails 38, 40 or items stored on the bottom wall 25. Similarly, tray 78 preferably should have a width smaller than the distance between the lower tray stops 50*a*, 52*a* and lower tray stops 50*b*, 52*b*, to allow tray 78 to slide longitudinally, so access can be gained to items stored on the bottom wall 25.

Also, preferably tray 76 should not have a width greater than tray 78, so that at least a portion of the contents of tray 78 are always viewable to an observer.

In this regard, the plane upper tray stops 46, 48 lie in is offset from the plane lower tray stops 50*a*, 52*a* lie in. This is especially important if tray 76 is the same width as tray 78 and both trays 76 and 78 are slid longitudinally as far to the front as possible (see FIG. 6), because tray 76 will not completely overlie either of trays 78 or 80, so that at least a portion of the contents of these trays 76, 78 is visible. The offset between the plane of the rear wall 24 and the plane lower tray stops 50*b*, 52*b* lie in accomplishes a similar purpose, by preventing tray 76 from completely overlying when trays 76 and 78 are slid as far away from the drawer front 22 as possible.

As discussed above, the glides 60*a*, 60*b*, 62*a*, 62*b* serve two purposes. First, since the tray supports 30, 32 and trays 76, 78 are usually made of metal, such as steel, the glides 60*a*, 60*b*, 62*a*, 62*b* facilitate sliding, both by being made of a material which provides a lower coefficient of friction (than the otherwise metal-to-metal contact of the flanges 92 of the trays 76 and 78 with the respective upper or lower rails 34, 36, 38, 40) and by having raised portions 72, 74 which provide smaller surface area contact and less surface friction. Second, the glides protect both the upper and lower rails 34, 36, 38, 40 from being scratched or otherwise damaged.

Though the glides 60*a*, 60*b*, 62*a*, 62*b* are shown disposed on the rails 34, 36, 38, 40 of the tray supports 30, 32, similar glides could be disposed on the lower surfaces of the flanges 92 of the trays 76, 78, 80 to accomplish the same two purposes. Additionally, the glides 60*a*, 60*b*, 62*a*, 62*b* could be replaced by a low-coefficient-of-friction medium, such as teflon tape, which could be applied to the rails 34, 36, 38, 40 or to the flanges 92 of the trays 76, 78, 80, or both.

Alternatively, the trays 76, 78, 80 and/or the tray supports 30, 32 could be made of a hard plastic which may make the glides unnecessary.

The bottom walls 82 of trays 76, 78, 80 may be equipped with rubber or foam mats or the like to prevent damage to the trays 76, 78, 80 and the contents placed on the trays 76, 78, 80. Also, the bottom walls 82 of the trays 76, 78, 80 may include sponges with adhesive backing to be used as tray partitions and to prevent movement of the contents placed on the tray. The sponge may be pre-molded to exactly fit the shape of the contents held on the tray.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A drawer having a longitudinal axis, the drawer comprising:

first and second generally parallel sidewalls, each having upper and lower ends;

front and back generally parallel sidewalls, each having upper and lower ends;

a bottom wall connecting the lower ends of the first, second, front and back sidewalls, and cooperating with said sidewalls to form an open-topped sliding storage container;

first and second tray supports respectively having first and second axial lengths and respectively connected to the first and second sidewalls and each disposed below the upper end of each of the first, second, front and back sidewalls;

an upper tray system supported on the first and second tray supports including at least one upper tray having an axial length substantially less than the axial lengths of each of the first and second tray supports and slideably supported on the first and second tray supports and slideable along the longitudinal axis of the drawer; and a lower tray system supported on the first and second tray supports and disposed above the botton wall and below the upper tray system, the lower tray system including at least one slideable lower tray having an axial length substantially less than the axial lengths of each of the first and second tray supports and supported on the first and second tray supports above the bottom wall for sliding movement along the longitudinal axis of the drawer.

2. The drawer of claim 1, wherein the lower tray system further includes a non-slideable lower tray supported on the first and second tray supports.

3. The drawer of claim 1, wherein the first tray support includes substantially parallel first upper and first lower rails and the second tray support includes substantially parallel second upper and second lower rails, the upper tray system being supported on the first and second upper rails and the lower tray system being supported on the first and second lower rails.

4. The drawer of claim 3, wherein the first upper rail includes a first upper tray stop and the second upper rail includes a second upper tray stop, the first and second upper tray stops limiting longitudinal movement of an associated upper tray supported on the first and second upper rails.

5. The drawer of claim 3, wherein the first lower rail includes a first lower tray stop and the second lower rail includes a second lower tray stop, the first and second lower tray stops limiting longitudinal movement of an associated lower tray supported on the first and, second lower rails.

6. The drawer of claims 3, and further comprising a low coefficient of friction medium disposed between the upper tray system and each of the first and second upper rails and between the lower tray system and each of the first and second lower rails.

7. The drawer of claim 3, and further comprising a low coefficient of friction medium disposed on each of the first and second upper and the first and second lower rails to facilitate tray sliding thereon.

8. The drawer of claim 3, and further comprising glide members for facilitating tray sliding disposed on each of the first and second upper and the first and second lower rails.

9. The drawer of claim 3, wherein the first and second sidewalls respectively include first and second apertures and the first and second tray supports include first and second support walls respectively connecting the first upper and lower rails and the second upper and lower rails, the first and second tray supports respectively including first and second tabs respectively protecting from the first and second support walls, the first tab disposed through the first aperture to connect the first tray support to the first sidewall and the second tab disposed through the second aperture to connect the second tray support to the second sidewall.

10. The drawer of claim 9, wherein each of the upper and lower trays has a flange at each of its lateral ends which slideably rests on an associated rail.

11. The drawer of claim 1, wherein the upper tray system includes at least one upper tray of different axial dimension than a lower tray of the lower tray system.

12. The drawer of claim 1, wherein at least one of the upper or lower tray systems includes at least two unconnected trays having different axial lengths.

13. The drawer of claim 1, wherein at least one of the upper or lower tray systems includes a plurality of unconnected trays, each having an axial length substantially less than the axial lengths of each of the first and second tray supports.

14. A drawer having a longitudinal axis, the drawer comprising:

front and back generally parallel sidewalls;

first and second generally parallel sidewalls;

a substantially contiguous bottom wall connecting the first, second, front and back sidewalls, and cooperating with said sidewalls to form an open-topped slidable storage container;

first and second tray supports respectively connected to the first and second sidewalls and each disposed below the upper end of each of the first, second, front and back sidewalls;

an upper tray system supported on the first and second tray supports including at least one upper tray slideably supported on the first and second tray supports and slideable along the longitudinal axis of the drawer; and a lower tray system supported on the first and second tray supports and disposed above the bottom wall and below the upper tray system, the lower tray system including at least one slideable lower tray supported on the first and second tray supports above the bottom wall for sliding movement along the longitudinal axis of the drawer, wherein at least one of the upper and lower tray systems includes a plurality of unconnected trays, each having an axial length substantially less than the axial lengths of each of the first and second tray supports.

15. A drawer having a longitudinal axis, the drawer comprising:

first and second generally parallel sidewalls;

a bottom wall connecting the first and second sidewalls;

first and second tray supports respectively connected to the first and second sidewalls;

an upper tray system supported on the first and second tray supports including at least one upper tray slideably supported on the first and second tray supports and slideable along the longitudinal axis of the drawer; and a lower tray system supported on the first and second tray supports and disposed above the bottom wall and below the upper tray system, the lower tray system including at least one slideable lower tray supported on the first and second tray supports above the bottom wall for sliding movement along the longitudinal axis of the drawer, and a non-slideable lower tray supported on the first and second tray supports.

* * * * *

UNITED STATES PATENT AND TRADEMARK OFFICE

CERTIFICATE OF CORRECTION

PATENT NO. : 5,927,839

DATED : July 27, 1999

INVENTOR(S) : Erick E. Alfaro

It is certified that error appears in the above-indentified patent and that said Letters Patent is hereby corrected as shown below:

Column 6, line 14, "protecting" should be --projecting--.

Signed and Sealed this

Eleventh Day of April, 2000

*Attest:*

*Attesting Officer*

Q. TODD DICKINSON

*Director of Patents and Trademarks*